US005306014A

United States Patent [19]

Langley

[11] Patent Number: 5,306,014

[45] Date of Patent: Apr. 26, 1994

[54] GOLF SWING TRAINING APPARATUS

[76] Inventor: Burton Langley, 1752 St. Tropez Ct., Kissimmee, Fla. 34744

[21] Appl. No.: 41,857

[22] Filed: Apr. 2, 1993

[51] Int. Cl.[5] ..... A63B 57/00

[52] U.S. Cl. ..... 273/201

[58] Field of Search ..... 273/32.5, 33, 201, 204, 273/35 R

[56] References Cited

U.S. PATENT DOCUMENTS

| | | | |
|---|---|---|---|
| 2,198,968 | 4/1940 | Jewett | 273/201 |
| 2,216,853 | 10/1940 | Middleton | 273/201 |
| 4,957,296 | 9/1990 | Turnidge et al. | 273/201 |
| 5,071,131 | 12/1991 | Turnidge et al. | 273/201 |

FOREIGN PATENT DOCUMENTS

| | | | |
|---|---|---|---|
| 0002921 | 7/1979 | European Pat. Off. | 273/201 |

*Primary Examiner*—William Stoll

*Attorney, Agent, or Firm*—Donald A. Kettlestrings

[57] ABSTRACT

Golf swing training apparatus enables positioning of golf balls by an instructor for striking by a student with a golf club to enable the student to hit his practice swing. The apparatus includes an open-ended elongated member and a supply magazine for golf balls removably and slidably positioned within the elongated member. A substantially L-shaped pin member is used by the instructor to selectively position the magazine and golf balls supported by the magazine in position with respect to the elongated member for striking of a ball by a student with a golf club as the student takes a practice swing.

12 Claims, 3 Drawing Sheets

Fig. 3.
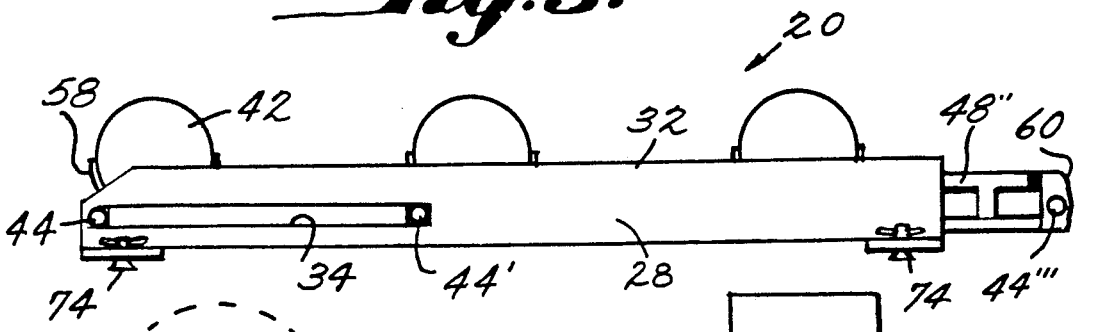
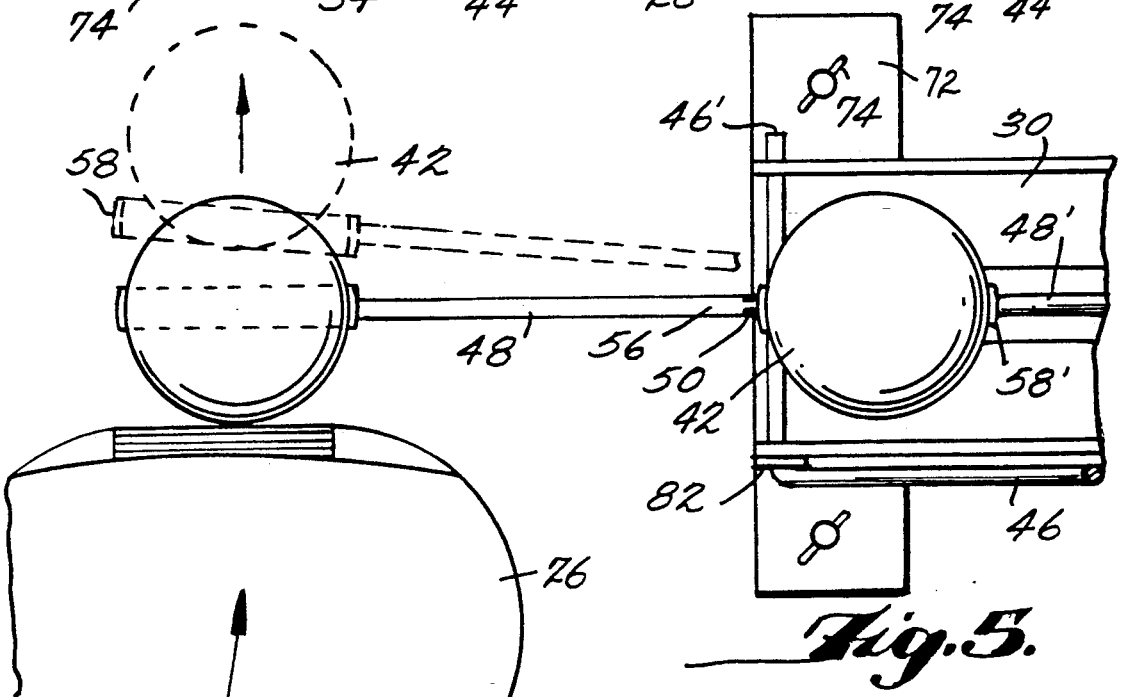
Fig. 5.
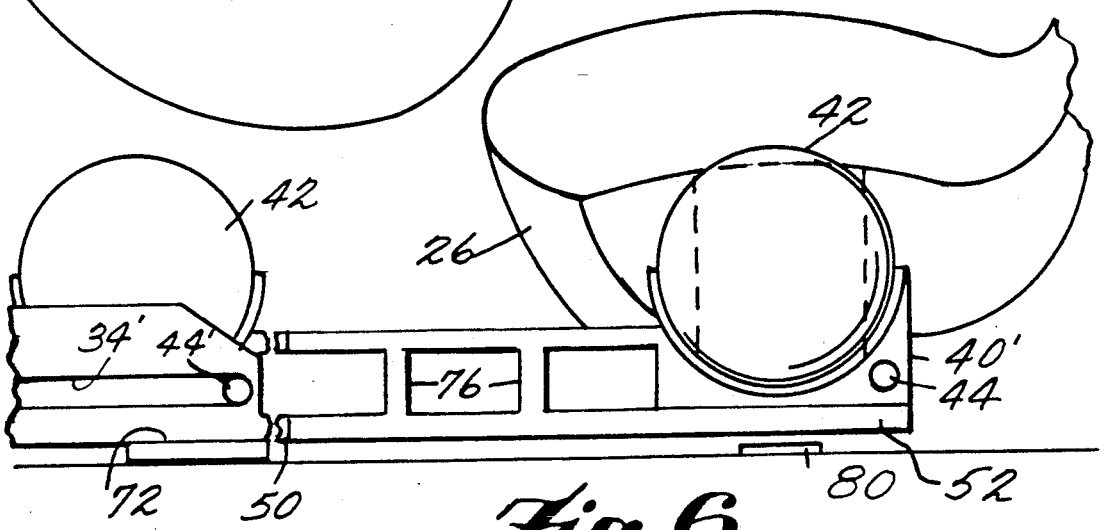
Fig. 6.

GOLF SWING TRAINING APPARATUS

BACKGROUND OF THE INVENTION

This invention relates to golf swing training apparatus and more particularly to apparatus which enables a golfer to learn to "hit his practice swing" when actually striking a golf ball.

Golfers often say "I wish I could hit my practice swing." When golfers take practice swings without having a golf ball positioned to be struck the golfer is often more relaxed and his swing is often more nearly the correct swing than when the golfer is actually swinging at a golf ball. Frequently, a golfer will become more tense and less fluid or natural in his swing when he is actually striking a ball, and golfers often complain that they wish they could make a swing when hitting the ball in the same manner that they make a swing when making practice swings.

It is, therefore, an object of the present invention to provide golf swing training apparatus which will teach golfers to swing at a golf ball in the same manner that they swing when making a practice swing.

Another object is to provide golf swing training apparatus for enabling an instructor to position golf balls for striking by a student with a golf club.

A further object of the invention is the provision of golf swing training apparatus which enables an instructor to position a golf ball for striking by a student with a golf club and wherein the golf ball can be so positioned after the student has already begun a practice swing.

Still another object is to provide golf swing training apparatus which is small and compact and which is inexpensive to manufacture.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides golf swing training apparatus which includes an open-ended, elongated member having a bottom wall and having first and second opposed sidewalls extending upwardly from the bottom wall; the first and second sidewalls respectively defining first and second opposed, elongated, closed-end slots therein, each of the slots extending along predetermined lengths of the sidewalls from positions adjacent to a first end of the elongated member; a guide track projecting upwardly from and extending substantially along the length of the bottom wall; an elongated supply magazine for golf balls removably and slidably positioned with respect to the guide track and defining a plurality of openings therein at predetermined spaced intervals along the length of the magazine; and a substantially L-shaped pin member for removable positioning by an instructor through the slots and through a selected one of the openings, whereby movement of the pin member toward the first end of the elongated member by the instructor causes the magazine to slide along the track toward the first end to present a golf ball in the magazine to a student for striking by a golf club.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

FIG. 3 is a fragmentary side elevation view of the apparatus;

FIG. 5 is a fragmentary top plan view of the apparatus showing a golf ball held by the apparatus being struck by a golf club, and showing in phantom lines a section of the magazine being broken away as the golf ball is struck by the club;

FIG. 6 is a fragmentary side elevation view of the apparatus showing a golf ball held by the apparatus being addressed by a golf club;

DESCRIPTION OF THE PREFERRED EMBODIMENT

Figure 1:
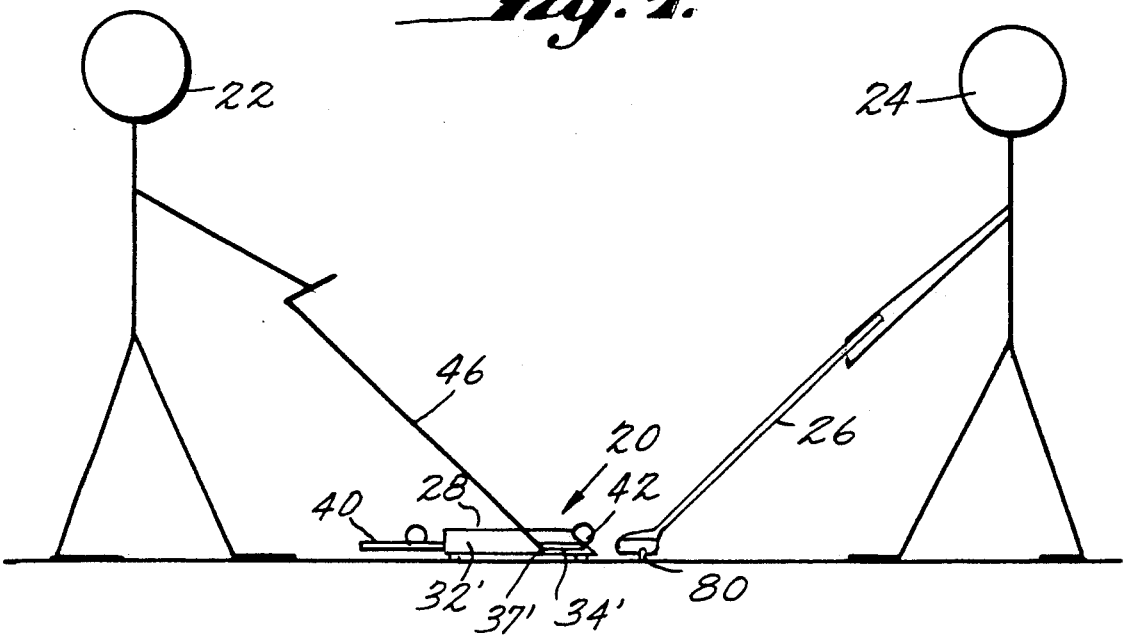
FIG. 1 is a side elevation view showing the apparatus in use.
Figure 4:
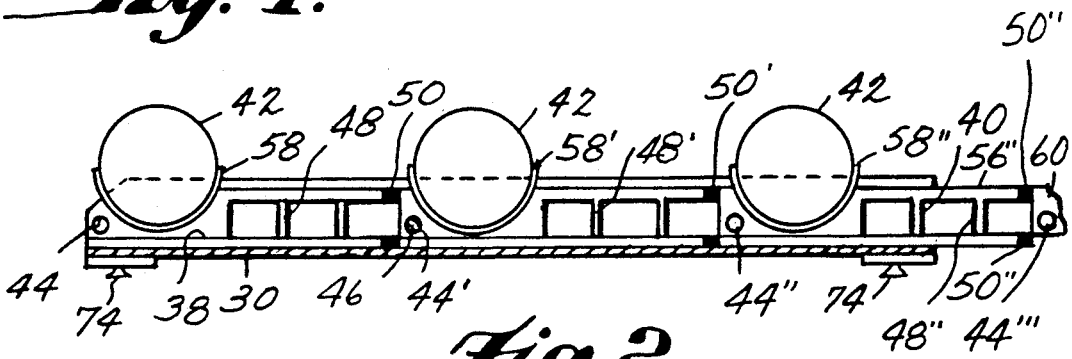
FIG. 4 is a cross-sectional view of the apparatus taken along the line 4—4 in FIG. 2 and looking in the direction of the arrows.
Figure 2:
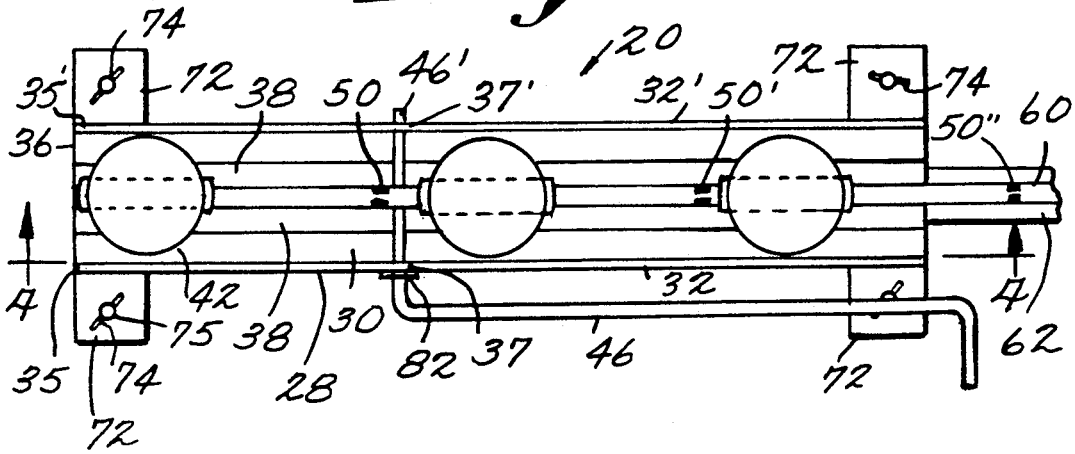
FIG. 2 is a fragmentary top plan view of the apparatus.

With reference now to the drawings, wherein like reference characters designate like or corresponding parts throughout the several views, there is shown golf swing training apparatus 20 for positioning golf balls 42 by an instructor 22 for striking by a student 24 with a golf club 26.

Apparatus 20 includes an open-ended, elongated member 28 having a bottom wall 30 and having first and second opposed sidewalls 32, 32' extending upwardly from bottom wall 30. First and second sidewalls 32, 32' respectively define first and second opposed, elongated, closed-end slots 34, 34' therein, and each of slots 34, 34' extends along predetermined lengths of the sidewalls from positions at or adjacent to a first end 36 of elongated member 28.

A guide track 38 projects upwardly from and extends substantially along the length of bottom wall 30. An elongated supply magazine 40 for golf balls 42 is removably and slidably positioned with respect to guide track 38, and magazine 40 defines a plurality of openings 44, 44', 44'', 44''' therein at predetermined spaced intervals along the length of magazine 40.

A substantially L-shaped pin member 46 is provided for removable positioning by instructor 22 through slots 34, 34' and through a selected one of openings 44–44''' whereby movement of pin member 46 toward first end 36 of elongated member 28 by the instructor causes magazine 40 to slide along track 38 toward first end 36 and to present a golf ball 42 in magazine 40 to the student for striking by golf club 26.

In accordance with the invention, golf ball supply magazine 40 comprises a plurality of magazine sections 48, 48', 48" and frangible connecting elements 50, 50' connect sections 48, 48', 48" together. Although three sections 48, 48', 48" are shown, it should be understood that more or less than three sections 48, 48', 48" can be provided in magazine 40.

Figures 7, 8:
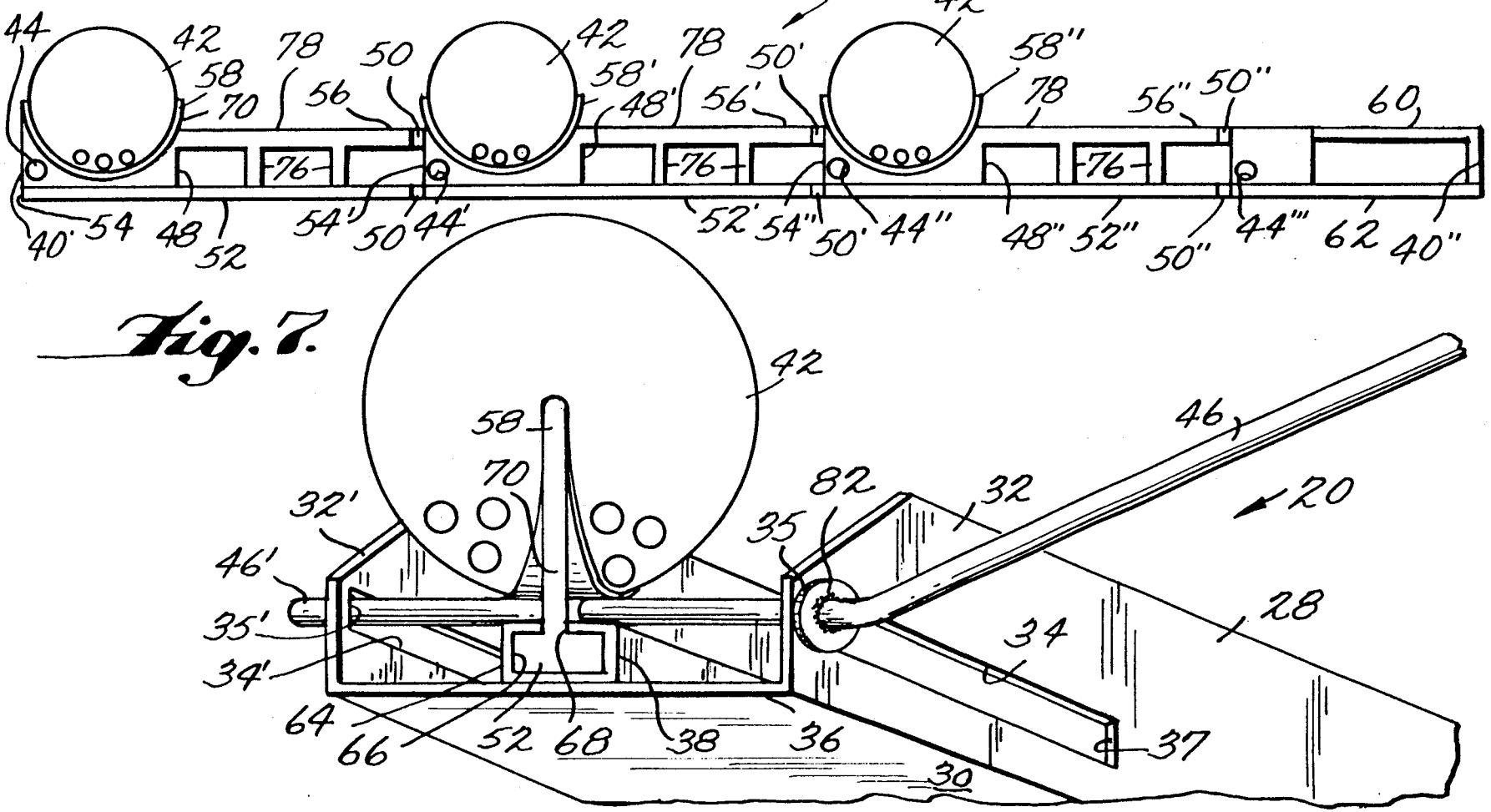
FIG. 7 is a fragmentary perspective view of the apparatus showing a golf ball supported by the apparatus and showing the pin member inserted in position.
FIG. 8 is a side elevation view of the supply magazine of the apparatus.

Each of magazine sections 48, 48', 48" includes a first elongated slide member 52, 52', 52", respectively, defining a forward end 54, 54', 54", respectively, and a rearward end 56, 56', 56", respectively. Each of slide members 52, 52', 52" is preferably rectangularly configured in cross section as shown in FIG. 7, to removably and slidably engage and to be held by track 38.

A golf ball support 58, 58', 58" is connected to and projects upwardly from respective slide members 52, 52', 52" at forward ends 54, 54', 54" thereof. Each of magazine sections 48, 48', 48" defines one of openings 44, 44', 44" therein adjacent to forward ends 54, 54', 54" of slide members 52, 52', 52", respectively, although no such opening is required in first section 48. Frangible connecting element 50 connects together slide members 52, 52' of adjacent magazine sections 48, 48', and frangible connecting element 50' connects together slide members 52', 52" of adjacent magazine sections 48', 48".

Magazine 40 defines a forward end 40' and a rearward end 40", and magazine 40 includes an end section 60 at rearward end 40". End section 60 includes a second slide member 62 which is configured in the same manner as slide members 52, 52', 52" to slidably engage track 38. One of openings 44"' is defined within end section 60, and a frangible end connecting element 50" connects together end section 60 and rearward end 56" of magazine section 48".

Slots 34, 34' are substantially equal in length to each other, and the length of each of slots 34, 34' is substantially equal to the sum of the diameter of one of openings 44, 44', 44" or 44"' and the center-to-center distance between two adjacent ones of openings 44, 44', 44" or 44"' in magazine 40. These dimensions are important for the successful and easy operation of apparatus 20, as will hereinafter be explained.

Guide track 38 preferably comprises an elongated open-ended channel member 64 which extends upwardly from bottom wall 30 and which defines an elongated substantially rectangular opening 66 and an elongated slot-like opening 68 in fluid communication with rectangular opening 66. See FIG. 7. Elongated slide members 52, 52', 52" and 62 are each configured to slidably fit within opening 66 of track 38. Also, predetermined portions 70 of each of golf ball supports 58, 58', 58" are configured to slidably fit within slot-like opening 68.

Apparatus 20 further preferably includes support legs 72 connected to elongated member 28, and wing head bolts 74 are adjustably connected to each of support legs 72 through openings 75 for enabling the position of apparatus 20 to be adjusted with respect to the ground or other surface upon which apparatus 20 is positioned.

Each of the elements of apparatus 20 can be made from plastic or other suitable material, but magazine 20 is preferably comprised of breakable plastic or styrofoam which will easily break or shatter upon being impacted by a golf club. See FIG. 5. Each of frangible connecting elements 50, 50', 50" can be formed by narrowing the dimensions of slide members 52, 52', 52", respectively, adjacent to rearward ends 56, 56', 56" of each of sections 48, 48', 48". In order to provide additional strength to each of sections 48, 48', 48" structural support elements 76, 78 can be provided.

Although apparatus 20 is shown with a magazine 40 supporting three golf balls 42, it is preferred that the magazine include a total of four sections for supporting four golf balls. The structure of each of the additional sections (not shown) and the connection of the additional sections by frangible connecting elements are identical to that shown in the drawings with respect to sections 48, 48' 48" and connecting elements 50, 50', 50". Although an opening 44 is shown in section 48, it should be understood that no opening needs to be provided in first section 48.

Elongated member 28 is shown to have a squared-off, channel-shaped configuration with sidewalls 32, 32' at right angles to bottom wall 30, but it should be understood that elongated member 28 could also be substantially hemispherical in cross-sectional configuration. Elongated member 28 may be open along its upper portion, or it may be enclosed with a wall (not shown) extending between upper edges of sidewalls 32, 32'. Elongated member 28 is preferably twelve inches in length, but different lengths can be provided. The width of bottom wall 30 is preferably two inches and the depth of sidewalls 32, 32' is preferably two inches. Magazine 40 is preferably eighteen inches long, and golf balls 42 are preferably held by supports 58, 58', 58" at a distance of four and one-half inches apart. Each of closed-end slots 34, 34' is preferably four and three-fourths inches long, and each of openings 44, 44', 44" and 44"' is preferably one-quarter inch in diameter. The center-to-center distance between adjacent ones of openings 44, 44' and 44" is preferably four and one-half inches.

In operation and use of apparatus 20, the apparatus is positioned on the ground or other surface and is levelled by adjustment of bolts 74 with respect to legs 72. A small marker 80 (FIGS. 1 and 6) is then placed on the ground to act as a guide for the student's practice swings. Marker 80 is placed beneath the position that a golf ball 42 will take when the instructor slides magazine 40 forward to present a golf ball for striking by the student.

The student takes a normal golf hitting stance and positions himself to align the head of golf club 26 with marker 80. The student is then instructed to take a series of practice swings with club 26 using marker 80 as a guide. During one of the practice swings by the student, the instructor will first activate apparatus 20 by inserting pin member 46 through slots 34, 34' and through opening 44', which has been prepositioned in alignment with rear ends of slots 34, 34'. A washer element 82 can be welded or otherwise attached to pin member 46 to prevent insertion of pin member 46 beyond a predetermined position with respect to slots 34, 34'.

The instructor will then push pin member 46 in a forward direction toward the student to cause magazine 40 to slide toward the student. The instructor will continue to push pin member 46 in a forward direction until the pin member engages forward ends 35, 35' of slots 34, 34', respectively. When pin member 46 reaches this position within slots 34, 34', golf ball 42 supported by golf ball support 58 will be positioned directly over marker 80 so that the golf ball will be struck by golf club 26 as the student takes one of his practice swings. See FIGS. 5 and 6.

Frangible connection 50 enables section 48 to break away from section 48' when golf club 26 strikes the golf ball 42 supported by section 48. Section 48 is comprised of plastic, styrofoam or other material which will break or shatter upon being struck by the golf club. As a result, the golf ball will take its normal flight upon being struck by golf club 26, and section 48 will shatter and/or will separate from section 48'.

The instructor will then remove pin member 46 from opening 44' and from slots 34, 34' and will reinsert the pin member through slots 34, 34' and through opening 44''. Because of the end-to-end dimensions of slots 34, 34' and the distance between openings 44', 44'' in magazine 40, pin member 46 is quickly and easily inserted through opening 44'' by the instructor by simply positioning the end 46' of the pin member immediately adjacent to a rearward end 37 of slot 34, for example, and by then slidably moving end 46' of pin member 46 through opening 44'' and then through slot 34'. The instructor then positions the second golf ball 42 supported by section 48' into position for striking by the student in the same manner as previously described for positioning the first golf ball 42 supported by section 48.

After the last golf ball supported by magazine 40 has been struck by the student, the instructor will slidably remove end section 60 from track 38 and the instructor can insert a new magazine 40 into track 38. The process can then be repeated with the new magazine.

Typically, the instructor will position a golf ball 42 into position for striking by the student's golf club after the student has started downwardly with a practice swing. Because the student will not know on which of his practice swings the instructor will move a golf ball into position for striking by the student, when the student does hit a golf ball so positioned by the instructor the student will actually "hit his practice swing."

The invention in its broader aspects is not limited to the specific details shown and described, and departures may be made from such details without departing from the principles of the invention and without sacrificing its chief advantages.

What is claimed is:

1. Golf swing training apparatus for positioning golf balls by an instructor for striking by a student with a golf club, said apparatus comprising:

an open-ended, elongated member having a bottom wall and having first and second opposed sidewalls extending upwardly from said bottom wall;

said first and second sidewalls respectively defining first and second opposed, elongated, closed-end slots therein, each of said slots extending along predetermined lengths of said sidewalls from positions at a first end of said elongated member;

a guide track projecting upwardly from and extending substantially along the length of said bottom wall;

an elongated supply magazine for golf balls removably and slidably positioned with respect to said guide track and defining a plurality of openings therein at predetermined spaced intervals along the length of said magazine; and a substantially L-shaped pin member for removable positioning by an instructor through said slots and through a selected one of said openings, whereby movement of said pin member toward said first end of said elongated member by the instructor causes said magazine to slide along said track toward said first end to present a golf ball in said magazine to a student for striking by a golf club.

2. Apparatus as in claim 1 wherein said golf ball supply magazine comprises a plurality of magazine sections, and frangible connecting elements connecting said sections together.

3. Apparatus as in claim 2 wherein a predetermined number of said sections each includes:

a first elongated slide member defining forward and rearward ends and configured to removably and slidably engage said track;

a golf ball support connected to and projecting upwardly from said slide member at said forward end thereof;

each of said magazine sections defining one of said openings therein adjacent to said forward end of said slide member; and each of said frangible connecting elements connecting together said slide members of adjacent ones of said magazine sections.

4. Apparatus as in claim 3 wherein said magazine defines forward and rearward ends and further including an end section at said rearward end of said magazine having a second slide member configured to slidably engage said track, one of said openings defined within said end section, and a frangible end connecting element connecting together said end section and a rearward end of one of said magazine sections.

5. Apparatus as in claim 4 wherein said first and second slots are substantially equal in length to each other.

6. Apparatus as in claim 5 wherein the length of each of said slots is substantially equal to the sum of the diameter of one of said openings and the center-to-center distance between two adjacent ones of said openings in said magazine.

7. Apparatus as in claim 6 wherein said guide track comprises an elongated open-ended channel member extending upwardly from said bottom wall and defining an elongated substantially rectangular opening and an elongated slot-like opening in fluid communication with said rectangular opening.

8. Apparatus as in claim 7 wherein said elongated slide members in said magazine sections and said end section are each configured to slidably fit within said elongated substantially rectangular opening of said guide track.

9. Apparatus as in claim 8 wherein predetermined portions of each of said golf ball supports are configured to slidably fit within said elongated slot-like opening.

10. Apparatus as in claim 9 further including support legs connected to said elongated member.

11. Apparatus as in claim 10 further including wing head bolts adjustably connected to said support legs for enabling the position of said apparatus to be adjusted with respect to the ground upon which the apparatus is positioned.

12. Apparatus as in claim 11 wherein said magazine is comprised of plastic.

* * * * *